US006954131B2

(12) United States Patent
DuVal

(10) Patent No.: US 6,954,131 B2
(45) Date of Patent: Oct. 11, 2005

(54) ELECTRICAL REACTOR ASSEMBLY HAVING CENTER TAPS

(75) Inventor: Randall J. DuVal, Appleton, WI (US)

(73) Assignee: Illinois Tool Works Inc., Glenview, IL (US)

( * ) Notice: Subject to any disclaimer, the term of this patent is extended or adjusted under 35 U.S.C. 154(b) by 35 days.

(21) Appl. No.: 10/249,339

(22) Filed: Apr. 2, 2003

(65) Prior Publication Data

US 2004/0196128 A1 Oct. 7, 2004

(51) Int. Cl.[7] ..... H01F 27/28
(52) U.S. Cl. ..... 336/212; 336/183
(58) Field of Search ..... 336/60, 84, 183–185, 336/206–207, 212

(56) References Cited

U.S. PATENT DOCUMENTS

| | | | | |
|---|---|---|---|---|
| 1,852,605 A | | 4/1932 | Carlton et al. | |
| 2,439,827 A | | 4/1948 | Sterenbuch et al. | |
| 2,474,395 A | | 6/1949 | Early et al. | |
| 3,058,077 A | | 10/1962 | Cornell | |
| 3,068,435 A | | 12/1962 | Oliver et al. | |
| 3,185,948 A | | 5/1965 | Helburg | |
| 3,346,828 A | | 10/1967 | Buschman | |
| 3,365,686 A | | 1/1968 | Petersen | |
| 3,497,848 A | | 2/1970 | Corrigall | |
| 3,569,885 A | | 3/1971 | Hilgers | |
| 3,727,161 A | | 4/1973 | Ruckel et al. | |
| 3,851,287 A | * | 11/1974 | Miller et al. | 336/84 R |
| 3,925,885 A | | 12/1975 | Smith | |
| 4,814,736 A | | 3/1989 | Lee et al. | |
| 4,837,497 A | * | 6/1989 | Leibovich | 323/345 |
| 5,619,176 A | | 4/1997 | Hays | |
| 5,952,908 A | | 9/1999 | Kubo | |
| 6,118,361 A | | 9/2000 | Ogawa | |
| 6,433,664 B1 | * | 8/2002 | Ishii et al. | 336/185 |

* cited by examiner

*Primary Examiner*—Lincoln Donovan
*Assistant Examiner*—Jennifer A. Poker
(74) *Attorney, Agent, or Firm*—Ziolkowski Patent Solutions Group, SC

(57) ABSTRACT

An electrical reactor assembly and method of assembly is disclosed. The reactor is formed from a combination of a magnetic T-core and a pair of magnetic L-cores. A plurality of comb-like separators is placed over a vertical portion of the T-core. A wire, with a rectangular cross-section, is wound about the vertical portion of the T-core thereby forming a coil. The comb-like separators electrically isolate the wire from adjacent windings and the T-core. The L-cores are attached to the T-core such that they flank two sides of the coil. A plurality of taps is formed on a side of the coil that is not flanked by one of the L-cores. The taps are formed by extending individual windings further from the T-core than other common windings. Preferably, a hole is formed through the rectangular wire at the taps to provide a secure electrical connection to the wire.

23 Claims, 5 Drawing Sheets

ELECTRICAL REACTOR ASSEMBLY HAVING CENTER TAPS

BACKGROUND OF INVENTION

The present invention relates generally to welding-type devices and, more particularly, to an electrical reactor assembly having a plurality of electrical taps formed in the windings of the reactor.

Reactor assemblies are commonly used in welding-type devices to condition and control a power signal so that it may be used in supplying power such as in a welding process. For example, reactor assemblies are often implemented in the electrical circuitry of a welding-type device to control the current provided to the work-piece and supplied by a boost converter assembly. Boost converters are frequently used so that the welding-type device may be operated on a variable voltage source. That is, the boost converter enables the welding-type device to be operable with voltages ranging typically from 115 volts to 230 volts. Typically, the signal is input to a rectifier that in turn outputs the rectified power signal to the boost converter for conditioning whereupon the boost converter outputs a conditioned signal to the inverter of the welding-type device and creates AC power for transformers of the welding-type device.

Additionally, internal combustion engines have often been incorporated into welding-type devices so that the entire device is portable. Welding-type devices that include internal combustion engines as a power supply, generate an electrical signal such that the devices can power both a welding-type device as well as multiple electrical outlets. These devices generally include a generator to supply power for accessories. The combination of the engine to the welding-type device makes the welding device portable and also provides a remote source of power for tools such as grinders, drills, and saws.

Regardless of the source of the power supply, i.e. a wall plug or a portable engine, the electrical signal preferably needs to be conditioned and controlled by passage through a reactor. Typically, the reactor includes of a ferrite core and several turns of magnetic wire. The magnetic wire is generally isolated from the ferrite core through the use of foil insulation around the core or by insulating the wire itself. The reactor needs to electrically insulate individual windings from both adjacent windings and from the ferrite core. The insulation requirement often creates a reactor assembly with a generally closed construction. The closed construction of the reactor assembly inhibits cooling of the reactor. Reactors generally generate a considerable amount of heat due to the relatively high voltages and currents that pass therethrough. The generation of heat signifies electrical losses within the welding device. The closed construction of reactors inhibits cooling of the reactor which in turn increases the inefficiencies of the reactor which in turn reduce the overall efficiency of the welding-type device. The heat generation of the reactor is also detrimental to the reactor itself and can effectively shorten the operating life of the reactor. Additionally, the thermal losses that exist, are generated along the entire length of the wire of the reactor that is utilized to condition and control the electric signal passed through the reactor. These thermal inefficiencies result in increased operating expenses whether from increased fuel consumption by the engine or electrical power consumption.

It would therefore be desirable to design a reactor with multiple taps to limit the length of the reactor that is unnecessarily powered. It is also desirable to design a reactor that is sufficiently cooled during operation to reduce thermal inefficiencies of the welding-type device and prevent premature failure of the reactor. It would also be desirable to design the reactor that is easily and inexpensively assembled.

BRIEF DESCRIPTION OF INVENTION

The present invention is directed to a reactor for a welder-type device. Preferably the reactor includes a plurality of comb-like structures that provide electrical isolation of a wire wound onto a coil about a T-core. The coil includes a plurality of common windings and a plurality of tap windings. The comb-like structures also provide electrical isolation between adjacent windings. The tap windings extend past the common windings along a common side of the T-core. Additionally, a pair of L-cores is attached to the T-core such that the L-cores flank opposing sides of the coil. All of which overcome the aforementioned drawbacks.

Therefore in accordance with a first aspect of the present invention, an electrical reactor is disclosed. The electrical reactor has a magnetic core. A wire is wound concentric to the magnetic core to form a coil. A plurality of taps is formed integrally in the wound wire by extending a plurality of individual windings beyond adjacent windings.

In accordance with another aspect of the present invention, an apparatus to provide multiple voltages to a welder-type device is disclosed. The apparatus includes a magnetic T-core and a pair of magnetic L-cores. A wire is wound about the T-core multiple times thereby forming a plurality of windings which thereby form a coil. A selected number of the windings are wound with a larger air gap than the air gap formed by a majority of the windings.

In accordance with yet another aspect of the present invention, a reactor includes a T-core with a wire wound about a vertical portion of the T-core to form a coil. The coil has a plurality of common windings and a plurality of tap windings. A pair of L-cores is attached to the T-core and thereby forms a first and a second window. The tap windings are formed by passing a winding from the first window to the second window and extending the tap winding farther from the vertical portion of the T-core than the common windings.

In accordance with yet another aspect of the present invention, a method of assembling a reactor is disclosed. The method comprises the steps of positioning a comb-like separator adjacent a T-core, winding a wire snuggly about the comb-like separator to form a common winding profile about the T-core, forming a plurality of tap windings by leaving a substantial gap between the tap winding and adjacent windings at a predetermined number of turns, and attaching a pair of L-cores to the T-core.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

As one skilled in the art will fully appreciate, the hereinafter description of welding devices not only includes welders, but also includes any system that requires high power outputs, such as heating and cutting systems. Therefore, the present invention is equivalently applicable with any device requiring high power output, including welders, plasma cutters, induction heaters, and the like. Reference to welding power, welding-type power, welding device, welder-type device, welder device, or welders generally, includes welding, cutting, or heating power. Description of a welding apparatus illustrates just one embodiment in which the present invention may be implemented. The present invention is equivalently applicable with any power system requiring multiple.

Figure 1:
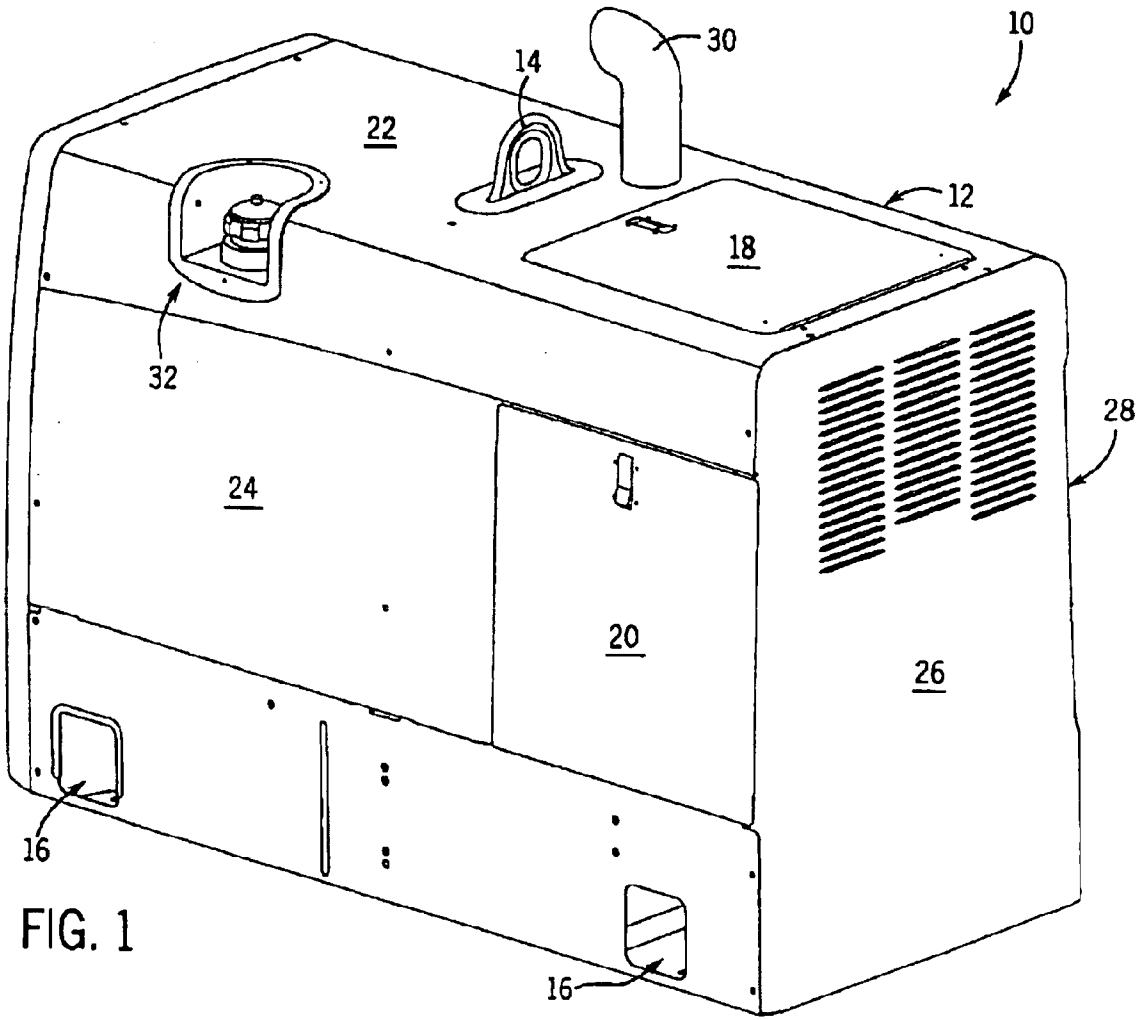
FIG. 1 is a perspective view of the welding device according to the present invention.

FIG. 1 shows a welding device 10. Welding device 10 includes a housing 12 which encloses the internal components of the welding device including, a reactor assembly as will be described in greater detail below. Optionally, welding device 10 includes a loading eye 14 and/or fork recesses 16. Loading eye 14 and fork recesses 16 facilitate the portability of welding device 10. Optionally, the welding device could include a handle and/or wheels as a means of device mobility. Housing 12 also includes a plurality of access panels 18, 20. Access panel 18 provides access to a top panel 22 of housing 12 while access panel 20 provides access to a side panel 24 of housing 12. A similar access panel is available on an opposite side. An end panel 26 includes a louvered opening 28 to allow for air flow through housing 12.

Housing 12 of welding-type device 10 also houses an internal combustion engine. The engine is evidenced by an exhaust 30 and a fuel port 32 that protrude through housing 12. Exhaust 30 extends above top panel 22 of housing 12 and directs exhaust emissions away from the welding-type device 10. Fuel port 32 preferably does not extend beyond top panel 22 or side panel 24. Such a construction protects fuel port 32 from damage during transportation and operation of welding-type device 10. Although shown to include an engine, the present invention is equally applicable to welding-type devices that require an external power source.

Figure 2:
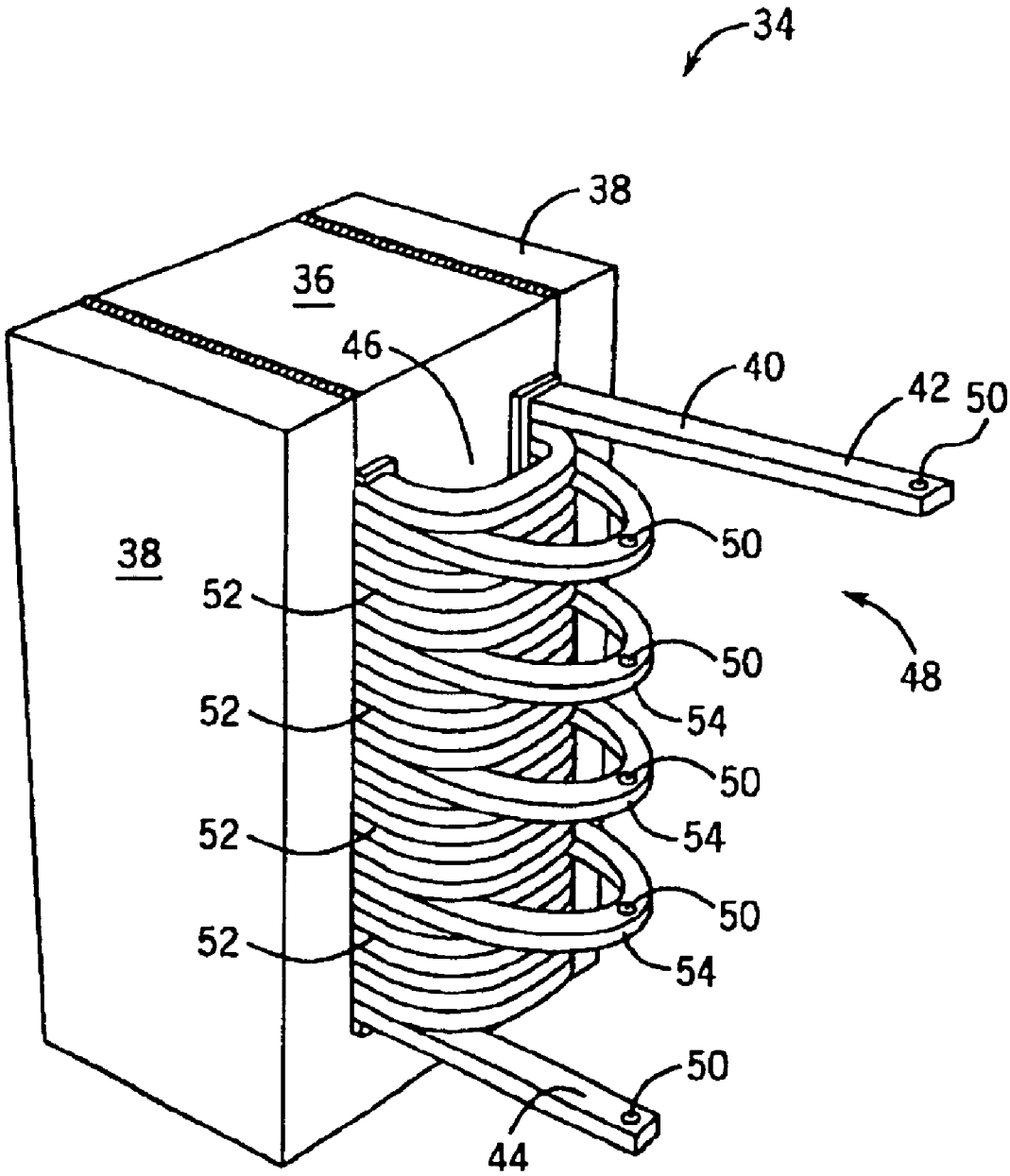
FIG. 2 is a perspective view of an electrical reactor assembly used in the welding device shown in FIG. 1.

Housing 12 protects the internal combustion engine and the internal components of welding-type device 10 or internal generator components. One such component is a reactor assembly 34 as shown in FIG. 2. Reactor assembly 34 includes a T-core 36 and a pair of L-cores 38. T-core 36 and L-cores 38 are preferably formed of a ferrite material with desirable magnetic attributes. A wire 40 is wound from a first end 42 to a second end 44 about a vertical portion 46 of T-core 36 to form a coil 48. First end 42 and second end 44 of coil 48 each include a wire hole 50. Wire holes 50 provide electrical supply connections to wire 40 of coil 48. Coil 48 includes a plurality of common windings 52 and a plurality of tap windings 54 formed between first end 42 and a second end 44 of coil 48. Tap windings 54 provide electrical access to coil 48 at different potentials by extending further from T-core 36 than common windings 52. Preferably, wire holes 50 provide electrical access to coil 48 at tap windings 54. Assuming coil 48 is energized from first end 42 through one of the tap windings 54, that portion of the coil 48 outside of this circuit would not be energized and therefore would not generate thermal losses. That is, no more of the reactor needs to be powered than is necessary for the desired device output. This ability thereby reduces overall losses when compared to a reactor without tap windings.

Figure 3:
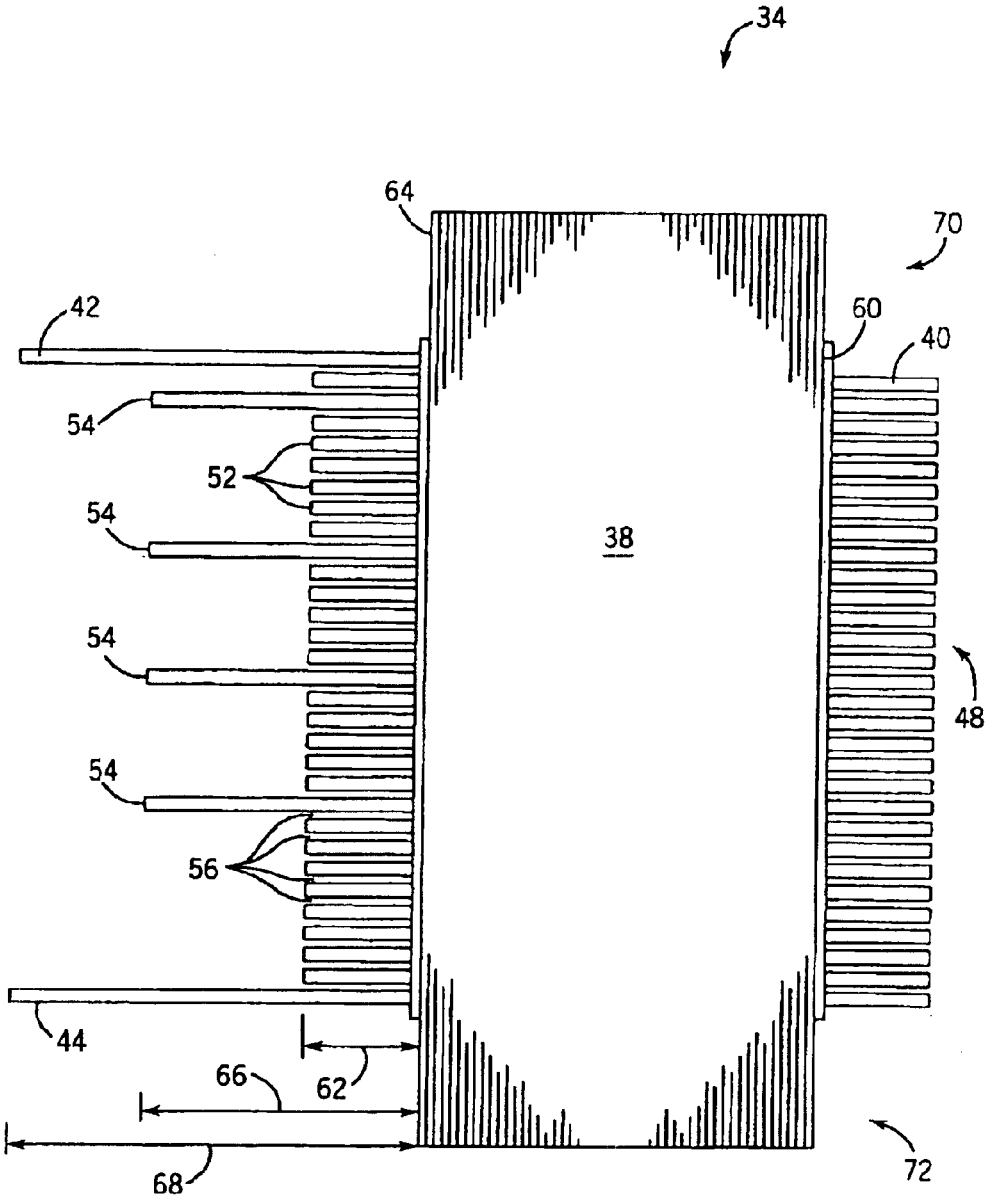
FIG. 3 is a side elevational view of the electrical reactor assembly shown in FIG. 2.

FIG. 3 shows a side view of the reactor assembly 34 of FIG. 2. Common windings 52 and tap windings 54 are separated by a distance 56. Distance 56 is determined by a fin of comb-like separator, as will be addressed in reference to FIG. 4 below. Distance 56 is uniform throughout coil 48. Additionally, common windings 52 extend a distance 62 from a side surface 64 of L-core 38. Tap windings 54 extend a distance 66 from side surface 64 of L-core 38 that is farther than common winding distance 52. In one embodiment, first end 42 and second end 44 of wire 40 of coil 48 extend a distance 68 from side surface 64 of L-core 38 that is still further than tap winding distance 66. As such, first end 42 and second end 44 extend further from L-core 38 than tap windings 54 which in turn extend further from L-core 38 than common windings 52. Additionally, coil 48 does not extend into an upper portion 70 and a lower portion 72 of reactor assembly 34.

Figure 4:
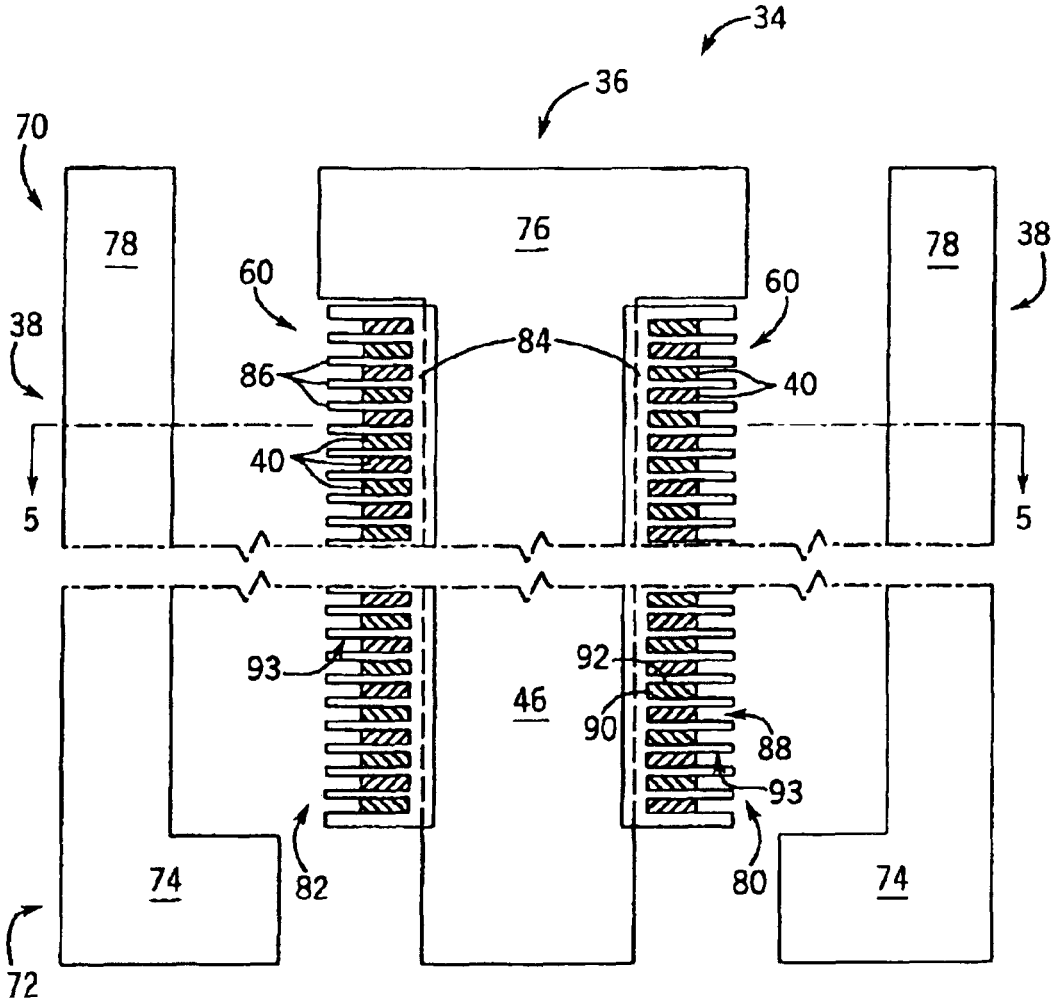
FIG. 4 is a cross-sectional exploded side, elevation view of the electrical reactor assembly shown in FIG. 2.

FIG. 4 shows upper portion 70 and lower portion 72 of reactor assembly 34 in a broken and partially exploded view. The upper and lower portions 70, 72 connect a plurality of horizontal portions 74 of L-cores 38 and a horizontal portion 76 of T-core 36. Horizontal portions 74 of L-cores 38 are attached to vertical portion 46 of T-core 36 at lower portion 72 of reactor assembly 34. A vertical portion 78 of L-cores 38 is attached to horizontal portion 76 of T-core 36 at upper portion 70 of reactor assembly 34. This construction, when assembled, forms a first window 80 and a second window 82 through reactor assembly 34. Positioned in first window 80 and second window 82, along vertical portion 46 of T-core 36, are comb-like separators 60. These comb-like separators 60 each have a longitudinal base 84 adjacent vertical portion 46 of T-core 36. Extending from longitudinal base 84 of comb-like separators 60 are a plurality of fins 86. The thickness of fins 86 determines distance 56 between adjacent windings as discussed with respect to FIG. 3 and is generally selected to snuggly retain the windings therein. Referring back to FIG. 4, wire 40 is snuggly disposed between adjacent fins 86 of comb-like separator 60. Comb-like separator 60 provides electrical isolation of wire 40 from adjacent windings and from T-core 36. Additionally, comb-like separator 60 extends past wire 40 toward L-cores 38 to provide the necessary gap between wire 40 and the L-cores 38 of coil 48.

As shown in FIG. 4, wire 40 has a rectangular cross section 88 that forms a pair of short sides 90 and a pair of long sides 92. One of short sides 90 of wire 40 is wound adjacent separator base 84 of comb-like separator 60. Long sides 92 of wire 40 are parallel to fins 86 of comb-like separator 60. In effect, wire 40 is edge wound about vertical portion 46 of T-core 36. An end portion 93 of fins 86 of comb-like separator 60 is not in direct contact with wire 40. End portion 93, not only provides the aforementioned gap, but also further protects wire 40 and provides improved cooling of wire 40 by functioning similar to a fin of a heat sink. In effect, end portion 93 dissipates heat from wire 40 to the atmosphere.

Figure 5:
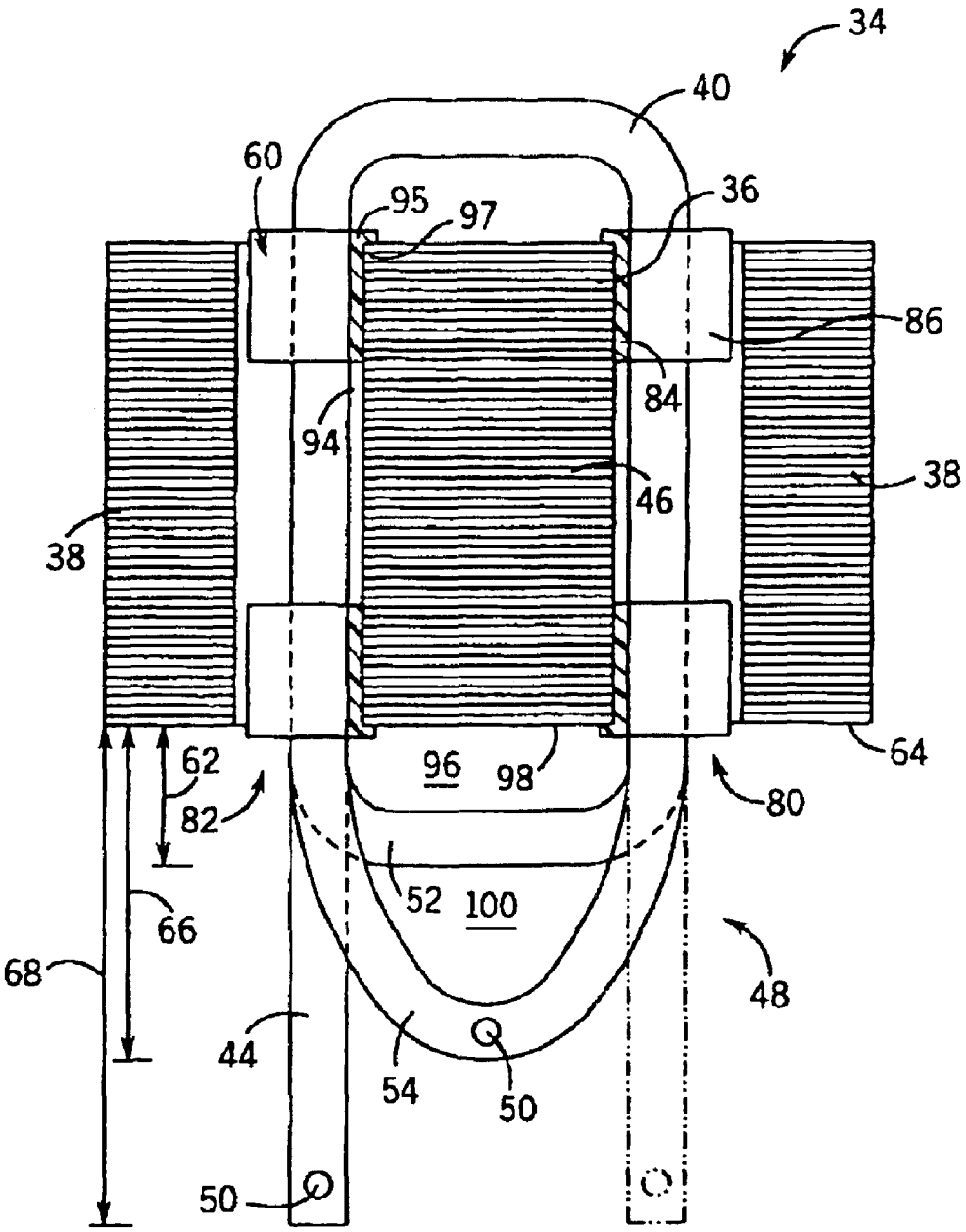
FIG. 5 is a cross-sectional top view at line 5—5 of the electrical reactor assembly shown in FIG. 4

FIG. 5 is a top view of the reactor assembly 34 of FIG. 4 broken at line 5—5. Common windings 52 and tap windings 54 of coil 48 surround vertical portion 46 of T-core 36. Comb-like separators 60 maintain a gap 94 between the coil 48 and vertical portion 46 of T-core 36. Gap 94 is determined by the thickness of separator base 84 of comb-like separator 60. Base 84 of comb-like separator 60 also has an L-shaped cross-section 95. L-shaped cross-section 95 of base 84 of comb-like separator 60 positions comb-like separator 60 on a corner 97 of vertical portion 46 of T-core 36. Although FIG. 5 shows four independent separators 60, it is within the scope of the present disclosure and claims that the number of separators can vary so long as isolation is maintained between adjacent coil windings and the magnetic core.

An air space 96 is defined generally by the space enclosed by common winding 52 and a side 98 of vertical portion 46 of T-core 36. A second air gap 100 is defined as a space generally enclosed by tap winding 54 and side 98 of vertical portion 46 of T-core 36. Tap windings 54 extend further from side 98 of vertical portion 46 of T-core 36 than common windings 52. Additionally, tap windings 54 include wire holes 50 for improved electrical connectivity to the reactor assembly 34 at tap windings 54. The structure of reactor assembly 34 provides access to multiple predetermined electrical parameters of coil 48 while also providing a structure that limits thermal losses of the reactor assembly 34 of the welding device 10.

Therefore in accordance with an embodiment of the present invention, a magnetic core of an electrical reactor is provided. A wire is wound concentric to the magnetic core to form a coil. A plurality of taps is formed integrally in the wound wire by extending a plurality of individual windings beyond adjacent windings.

In accordance with another embodiment of the present invention, an apparatus to provide multiple voltages to a welder-type device is provided. The apparatus includes a magnetic T-core and a pair of magnetic L-cores. A wire is wound about the T-core multiple times thereby forming a plurality of windings which thereby form a coil. A selected number of the windings are wound with a larger air gap than the air gap formed by a majority of the windings thereby forming electrical taps in the coil of the reactor assembly.

The present invention includes a reactor with a T-core and a wire wound about a vertical portion of the T-core to form a coil. The coil has a plurality of common windings and plurality of tap windings. A pair of L-cores is attached to the T-core and thereby forms a first and a second window. The tap windings are formed by passing a winding from the first window to the second window and extending the winding further from the vertical portion of the T-core than the common windings.

The present invention also includes a method of assembling a reactor. The method includes the steps of positioning a comb-like separator adjacent a T-core, winding a wire snuggly about the comb-like separator to form a common winding profile about the T-core, forming a plurality of tap windings by leaving a substantial gap between the tap winding and adjacent windings at a predetermined number of turns, and attaching a pair of L-cores to the T-core.

The present invention has been described in terms of the preferred embodiment, and it is recognized that equivalents, alternatives, and modifications, aside from those expressly stated, are possible and within the scope of the appending claims.

What is claimed is:

1. An apparatus to provide multiple voltages to a welder-type device comprising:

a magnetic T-core and a pair of magnetic L-cores; and a wire wound about the magnetic T-core a plurality of times forming a plurality of windings thereby forming a coil, wherein a selected number of windings are wound with a larger air gap between the wire and the magnetic T-core than that formed by a majority of the windings.

2. The apparatus of claim 1 wherein the wire has a rectangular cross-section.

3. The a status of claim 2 further comprising at least one comb-like separator located between the coil end the T-core to electrically insulate the plurality of windings from adjacent windings and from the T-core.

4. The apparatus of claim 1 wherein the majority of the windings are wound to form a defined air gap between the winding mud the magnetic T-core.

5. The apparatus of claim 1 wherein the taps are aligned along one side of the coil.

6. The apparatus of claim 2 wherein the air gap formed by the majority of the windings is larger than a thickness of the wire.

7. The apparatus of claim 3 wherein the comb-like separator has a plurality of uniform recesses that receive the wire and a plurality of uniform fingers located between the plurality of windings.

8. The apparatus of claim 1 wherein the majority of windings have a substantially rectangular cross-section.

9. The apparatus of claim 3 wherein the wire fits snuggly on three sides of the comb-like separator.

10. A reactor comprising:

a center core having a vertical portion and a horizontal portion;

a wire wound about the vertical portion of the center core thereby forming a coil;

the coil having a plurality of common windings and a plurality of tap windings; and a pair of end cores attached to the center core to form a first and a second window wherein the tap windings are formed by passing a winding from the first window to the second window and extending the wire further from the vertical portion of the center core than the common windings.

11. The reactor of claim 10 wherein the wire has a rectangular cross-section with the longer side of the cross-section parallel to a horizontal portion of the center core.

12. The reactor of claim 10 further comprising a seperator located between the coil and center core to provide separation of adjacent coil windings.

13. The reactor of claim 10 wherein the tap windings are aligned parallel to an axis of the vertical portion of the center core.

14. The reactor of claim 10 wherein the plurality of tap windings include at least two tap windings.

15. The reactor of claim 10 wherein the plurality of tap windings are on a common side of the reactor.

16. The reactor of claim 10 further comprising at least one separator that extends past an end surface of the center core and separates adjacent windings.

17. A method of assembling a reactor comprising:

(A) positioning a comb-like separator adjacent a T-core;

(B) winding a wire snuggly about the comb-like separator to form a common winding profile about the T-core;

(C) winding the wire less snuggly to form a tap winding profile about the T-core;

(D) repeating steps (B) and (C) but winding the wire more often in accordance with step (B) that step (C);

(E) attaching a pair of L-cores to the T-core.

18. The method of claim 17 further comprising welding the L-cores to the T-core.

19. The method of claim 17 wherein positioning a comb-like separator adjacent a T-core is repeated four times.

20. The method of claim 17 wherein the tap windings are coaxially aligned.

21. The method of claim 17 wherein the wire has a rectangular cross-section.

22. The method of claim 21 wherein a short side of the rectangular cross-section is wound parallel to a winding surface of the T-core.

23. The reactor of claim 10 incorporated into a welding-type apparatus.

* * * * *

UNITED STATES PATENT AND TRADEMARK OFFICE

CERTIFICATE OF CORRECTION

PATENT NO. : 6,954,131 B2
DATED : October 11, 2005
INVENTOR(S) : DuVal

It is certified that error appears in the above-identified patent and that said Letters Patent is hereby corrected as shown below:

Column 5,
Line 64, delete “a status” and substitute -- apparatus --; and

Column 6,
Line 3, delete “mud” and substitute -- and --.

Signed and Sealed this

Third Day of January, 2006

JON W. DUDAS
*Director of the United States Patent and Trademark Office*